US007215285B2

(12) United States Patent
Song et al.

(10) Patent No.: US 7,215,285 B2
(45) Date of Patent: May 8, 2007

(54) BI-FREQUENCY SYMMETRICAL PATCH ANTENNA

(75) Inventors: Jia-Jiu Song, Taipei County (TW); Wei-Tong Cheng, Hsinchu (TW)

(73) Assignee: Smartant Telecom Co., Ltd., Hsinchu (TW)

( * ) Notice: Subject to any disclaimer, the term of this patent is extended or adjusted under 35 U.S.C. 154(b) by 22 days.

(21) Appl. No.: 11/168,391

(22) Filed: Jun. 29, 2005

(65) Prior Publication Data

US 2007/0001922 A1 Jan. 4, 2007

(51) Int. Cl.
*H01Q 1/38* (2006.01)

(52) U.S. Cl. ..... 343/700 MS; 343/850

(58) Field of Classification Search ..... 343/700 MS, 343/853, 795, 850

See application file for complete search history.

(56) References Cited

U.S. PATENT DOCUMENTS

| | | | | |
|---|---|---|---|---|
| 3,887,925 | A * | 6/1975 | Ranghelli et al. | 343/795 |
| 6,859,176 | B2 * | 2/2005 | Choi | 343/700 MS |
| 2001/0007446 | A1 * | 7/2001 | Amano | 343/860 |

* cited by examiner

*Primary Examiner*—Hoang V. Nguyen
(74) *Attorney, Agent, or Firm*—Birch, Stewart, Kolasch, & Birch, LLP.

(57) ABSTRACT

A bi-frequency symmetrical patch antenna includes two bi-frequency symmetrical radiation units, each having a first band radiation section and two second band radiation sections, to radiate a feed-in signal in a selected direction. Further, the antenna has a power distribution unit, to evenly distribute the feed-in power, corresponding to the feed-in signal, to each bi-frequency symmetrical radiation unit. The power distribution unit has two side arms connecting respectively to each bi-frequency symmetrical radiation unit to increase the bandwidth range of the bi-frequency antenna.

20 Claims, 10 Drawing Sheets the V-polarization radiation pattern of the first band (2. 4GHz)

the V-polarization radiation pattern of the first band (2. 45GHz)

the V-polarization radiation pattern of the first band (2. 5GHz)

the H-polarization radiation pattern of the first band (2. 4GHz)

the H-polarization radiation pattern of the first band (2. 45GHz)

the H-polarization radiation pattern of the first band (2. 5GHz)

the V-polarization radiation pattern of the second band (4. 9GHz)

the V-polarization radiation pattern of the second band (5. 25GHz)

the V-polarization radiation pattern of the second band (5. 6GHz)

the V-polarization radiation pattern of the second band (5. 875GHz)

the H-polarization radiation pattern of the second band (4. 9GHz)

the H-polarization radiation pattern of the second band (5. 25GHz)

the H-polarization radiation pattern of the second band (5. 6GHz)

the H-polarization radiation pattern of the second band (5. 875GHz)

BI-FREQUENCY SYMMETRICAL PATCH ANTENNA

FIELD OF THE INVENTION

The present invention relates to a patch antenna and particularly to a bi-frequency symmetrical patch antenna.

BACKGROUND OF THE INVENTION

With continuous developments of wireless communication technology, nowadays users can transmit information through wireless communication systems without geometric restrictions. An antenna is one of the important elements in wireless communication. At present the antenna made from a printed circuit board is most popular. It is easier to fabricate and costs less.

The commonly used wireless communication standards now are IEEE802.11 a and IEEE802.11b announced by the Electrical and Electronic Engineering Institute (IEEE). IEEE802.11a is for the band of 5 GHz. IEEE802.11b is for the band of 2.4 GHz. Design of the antenna baseboard has to comply with the corresponding bandwidth. If a wireless communication system has to be used in two different bands at the same time, matching antennas have to be provided. This causes inconvenience. To meet the requirement of different bands, adopting a bi-frequency antenna design is a growing trend. However, the present bi-frequency antenna still has drawbacks, such as an insufficient bandwidth and integration difficulties.

Hence how to provide a broadband bi-frequency antenna is one of the research and development focuses in the industry.

SUMMARY OF THE INVENTION

In view of the aforesaid problems, the primary object of the present invention is to provide a bi-frequency symmetrical patch antenna that has bi-frequency symmetrical radiation units to radiate feed-in signals and increase the bandwidth range of a bi-frequency antenna. The bi-frequency symmetrical radiation units are arranged in an array fashion to enhance the directionality of the bi-frequency antenna.

In order to achieve the foregoing object, the bi-frequency symmetrical patch antenna according to the invention has a first surface and a second surface to receive a feed-in signal and radiate the feed-in signal in a selected direction. It includes two bi-frequency radiation units and a power distribution unit.

Each of the two bi-frequency symmetrical radiation units has a first band radiation section and two second band radiation sections to radiate the feed-in signal. The first band radiation section has a length greater than the length of each second band radiation section.

The power distribution unit aims to evenly distribute feed-in power corresponding to the feed-in signal to each bi-frequency symmetrical radiation unit. The power distribution unit is substantially formed in a T-shape. It is connected to the first band radiation section and the two second band radiation sections through a first micro strip, a second micro strip and a third micro strip.

In another aspect, the invention provides an array type bi-frequency symmetrical patch antenna, which has a first surface and a second surface to receive a feed-in signal and radiate the feed-in signal in a selected direction. It includes one or more bi-frequency radiation units and one or more power distribution units.

Each bi-frequency symmetrical radiation unit has a first band radiation section and two second band radiation sections to radiate the feed-in signal. The first band radiation section has a length greater than the length of each second band radiation section.

The power distribution unit aims to evenly distribute feed-in power, corresponding to the feed-in signal, to each bi-frequency symmetrical radiation unit. The power distribution unit has two side arms connecting respectively to a distal end of a next power distribution unit, and the next power distribution unit has two other side arms connecting respectively to each bi-frequency symmetrical radiation unit. The power distribution unit is substantially formed in a T-shape.

By means of the bi-frequency symmetrical patch antenna of the invention, the bi-frequency symmetrical radiation unit can receive a feed-in signal to increase the bandwidth range of the bi-frequency antenna. The power distribution unit can evenly distribute the feed-in power, corresponding to the feed-in signal, to each bi-frequency symmetrical radiation unit. The bi-frequency symmetrical radiation unit may be arranged in an array fashion to enhance the directionality of the bi-frequency antenna.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
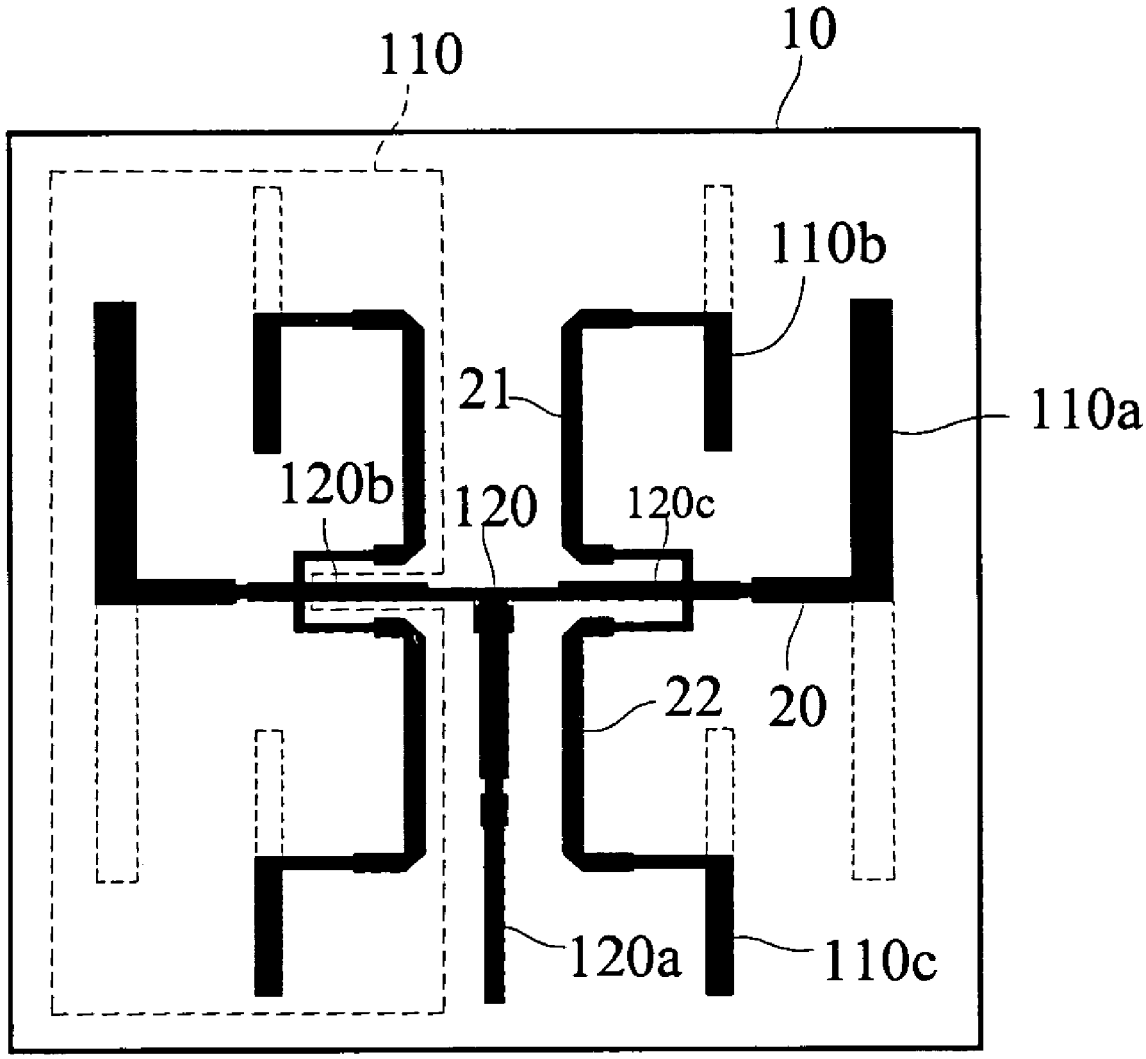
FIG. 1 is a schematic view of the bi-frequency symmetrical patch antenna of the invention.

Refer to FIG. 1 for a schematic view of the bi-frequency symmetrical patch antenna of the invention. The antenna includes an antenna baseboard 10, which has an antenna pattern formed thereon. The antenna baseboard 10 is made from glass fibers or the like. The antenna baseboard 10 has a first surface and a second surface that are respectively a circuit layer and a ground layer. The antenna pattern on the first surface and the second surface are symmetrical.

Figure 2A:
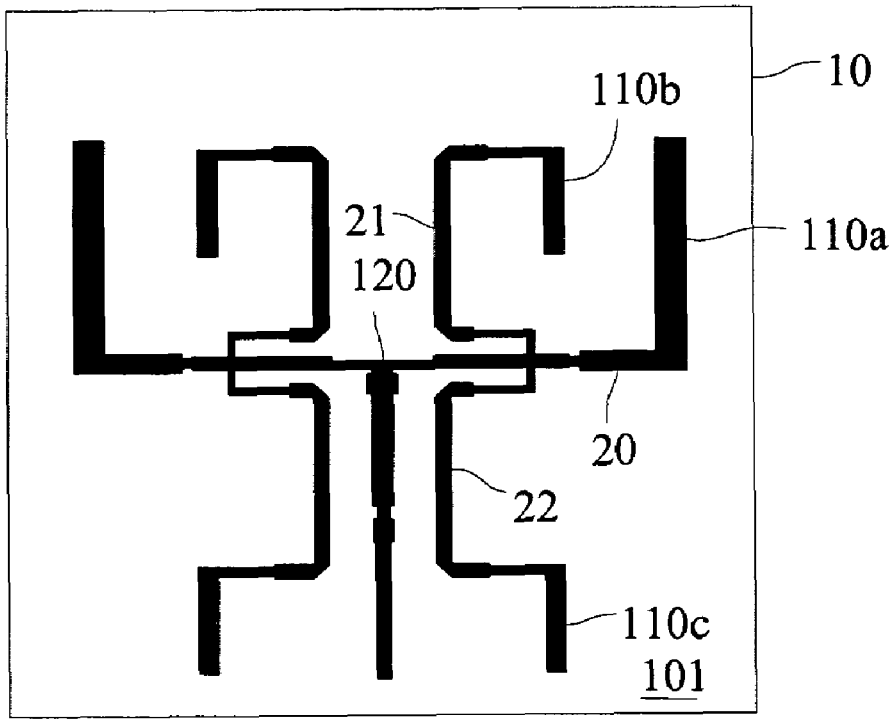
FIG. 2A is a schematic front view of the first surface of a first embodiment of the invention.

Refer to FIG. 2A for the front view of the first surface of a first embodiment of the invention. The first surface 101 has a micro strip circuit pattern of the circuit layer. In the center of the antenna baseboard 10, there is a power distribution unit 120. A radio signal feeds in through a distal end 120*a* of the power distribution unit 120. There are bi-frequency symmetrical radiation units 110, connecting respectively to two side arms 120*b* and 120*c*, to form a completed antenna pattern. The power distribution unit 120 evenly distributes feed-in power corresponding to the feed-in signal to each of the bi-frequency symmetrical radiation units 110.

The bi-frequency symmetrical radiation units 110 have a first band radiation section 110*a* and second band radiation sections 110*b* and 110*c*. The first band (such as 2.4 GHz) radiation section 110*a* is located on one side of a distal end of a first micro strip 20 and vertically connected to one side of the distal end of the first micro strip wire 20.

One second band (such as 5 GHz) radiation section 110*b* is located on a distal end of a second micro strip 21 and vertically connected to one side of the distal end of the second micro strip 21. The second micro strip 21 is formed in a zigzag path and substantially in a U-shape.

Another second band (such as 5 GHz) radiation section 110*c* is located on a distal end of a third micro strip 22 and is vertically connected to one side of the distal end of the third micro strip 22. The third micro strip 22 is formed in a zigzag path and substantially in a U-shape, and is symmetrical to the second micro strip 21.

In addition, the first band radiation section 110*a* is extended in a direction opposite to the second band radiation sections 110*b* and 110*c*. Namely, if the first band radiation section 110*a* is extended to one side of the antenna baseboard 10, the second band radiation sections 110*b* and 110*c* are extended to another side of the antenna baseboard 10 (based on the distal end of each micro strip).

The power distribution unit 120 evenly distributes the feed-in power corresponding to the feed-in signal through the first micro strip 20, second micro strip 21 and third micro strip 22, that are connected to the first band radiation section 110*a* and second radiation sections 110*b* and 110*c* of each bi-frequency symmetrical radiation unit 110. The power distribution unit 120 is substantially formed in a T-shape.

Figure 2B:
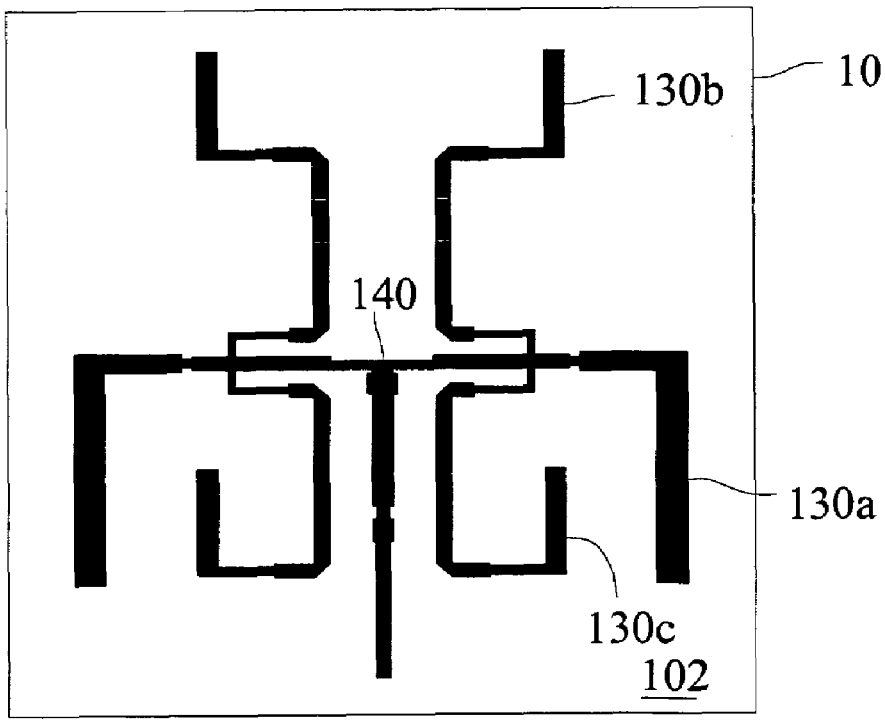
FIG. 2B is a schematic front view of the second surface of the first embodiment of the invention.

Refer to FIG. 2B for the front view of the second surface of the first embodiment of the invention. The second surface 102 has a micro strip circuit pattern of the ground layer. In the center of the antenna baseboard 10, there is a power distribution unit 140. There are bi-frequency symmetrical radiation units 130 connecting respectively to two side arms of the power distribution unit 140 to form a completed antenna pattern. The power distribution unit 140 evenly distributes the feed-in power corresponding to the feed-in signal to each of the bi-frequency symmetrical radiation units 130. The second surface 102 has a micro strip circuit pattern of the ground layer that is symmetrical to the micro strip circuit pattern of the circuit layer on the first surface 101. Namely, the first band radiation section 110*a*, and the second band radiation sections 110*b* and 110*c* are extended in the directions opposite to that of the first band radiation section 130*a*, and the second band radiation sections 130*b* and 130*c* and the antenna patterns are symmetrical.

Figure 3:
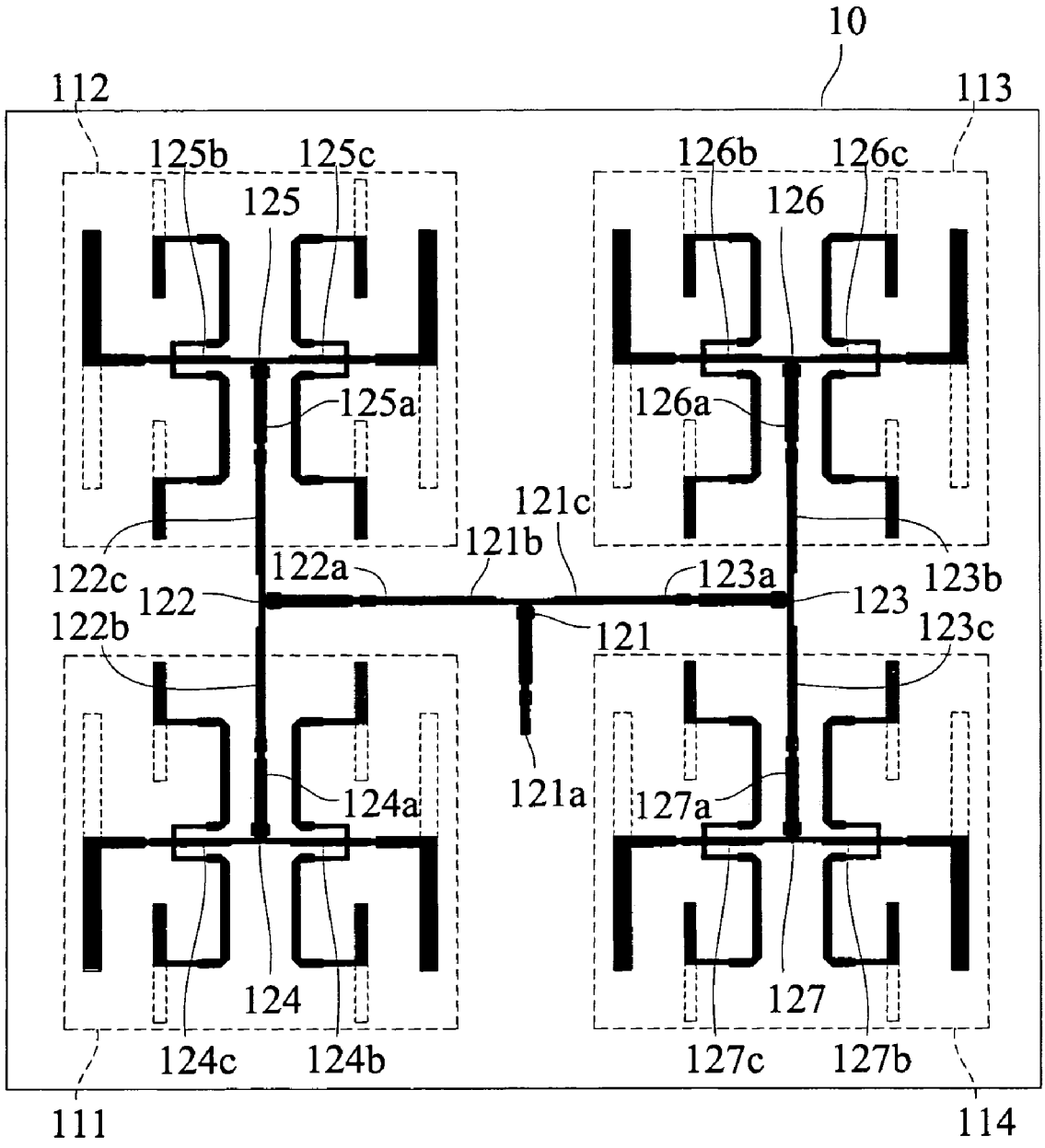
FIG. 3 is a schematic view of the antenna baseboard of a second embodiment of the invention.

Refer to FIG. 3 for a schematic view of the antenna baseboard of a second embodiment of the invention. The bi-frequency symmetrical radiation units are arranged in an array fashion through the power distribution units and connected to one another. The schematic view includes a first bi-frequency symmetrical radiation unit 111, a second bi-frequency symmetrical radiation unit 112, a third bi-frequency symmetrical radiation unit 113, a fourth bi-frequency symmetrical radiation unit 114, a first power distribution unit 121, a second power distribution unit 122, a third power distribution unit 123, a fourth power distribution unit 124, a fifth power distribution unit 125, a sixth power distribution unit 126, and a seventh power distribution unit 127.

The first bi-frequency symmetrical radiation unit 111, second bi-frequency symmetrical radiation unit 112, third bi-frequency symmetrical radiation unit 113, and fourth bi-frequency symmetrical radiation unit 114 are formed in an antenna pattern same as that shown in FIGS. 2A and 2B, thus details are omitted.

The first power distribution unit 121 has two side arms 121*b* and 121*c* connecting respectively to a distal end 122*a* of the second power distribution unit 122 and a distal end 123*a* of the third power distribution unit 123 to perform a first time power distribution. The second power distribution unit 122 has two side arms 122*b* and 122*c* connecting respectively to a distal end 124*a* of the fourth power distribution unit 124 and a distal end 125*a* of the fifth power distribution unit 125; the third power distribution unit 123 has two side arms 123*b* and 123*c* connecting respectively to a distal end 126*a* of the sixth power distribution unit 126 and a distal end 127*a* of the seventh power distribution unit 127, to perform respectively a second time power distribution.

Next, the fourth power distribution unit 124 has two side arms 124*b* and 124*c* connecting respectively to the first bi-frequency symmetrical radiation unit 111, the fifth power distribution unit 125 has two side arms 125*b* and 125*c* connecting respectively to the second bi-frequency symmetrical radiation unit 112, the sixth power distribution unit 126 has two side arms 126*b* and 126*c* connecting respectively to the third bi-frequency symmetrical radiation unit 113, and the seventh power distribution unit 127 has two side arms 127*b* and 127*c* connecting respectively to the fourth bi-frequency symmetrical radiation unit 114 to perform respectively a third time power distribution. Therefore, by evenly distributing the feed-in power corresponding to the feed-in signal of the first bi-frequency symmetrical radiation unit 111, second bi-frequency symmetrical radiation unit 112, third bi-frequency symmetrical radiation unit 113, and fourth bi-frequency symmetrical radiation unit 114, and arranging the first bi-frequency symmetrical radiation unit 111, second bi-frequency symmetrical radiation unit 112, third bi-frequency symmetrical radiation unit 113, and fourth bi-frequency symmetrical radiation unit 114 in an array fashion, the directionality of the antenna can be improved, and the directional gain is enhanced.

Figure 4A:
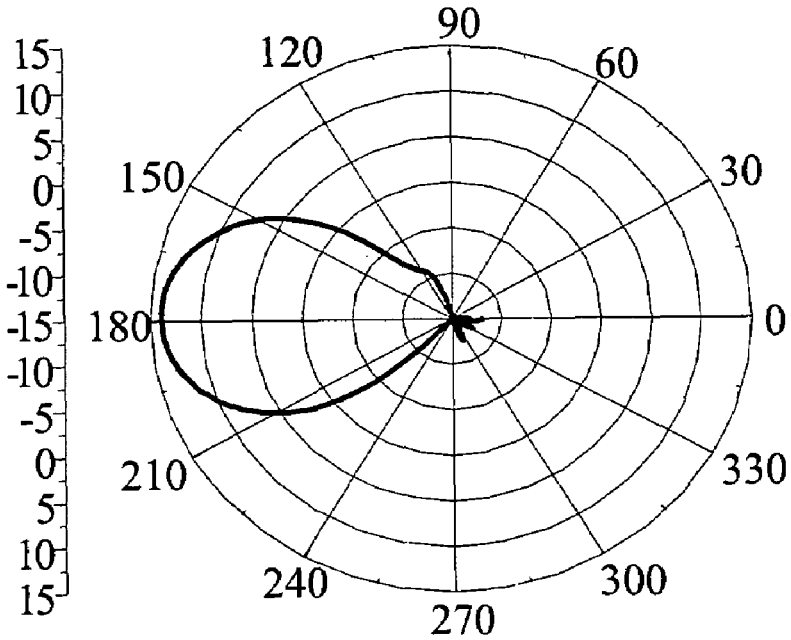
FIGS. 4A through 4C are charts showing the V-polarization radiation pattern of a first band according to the invention.
Figure 4B:
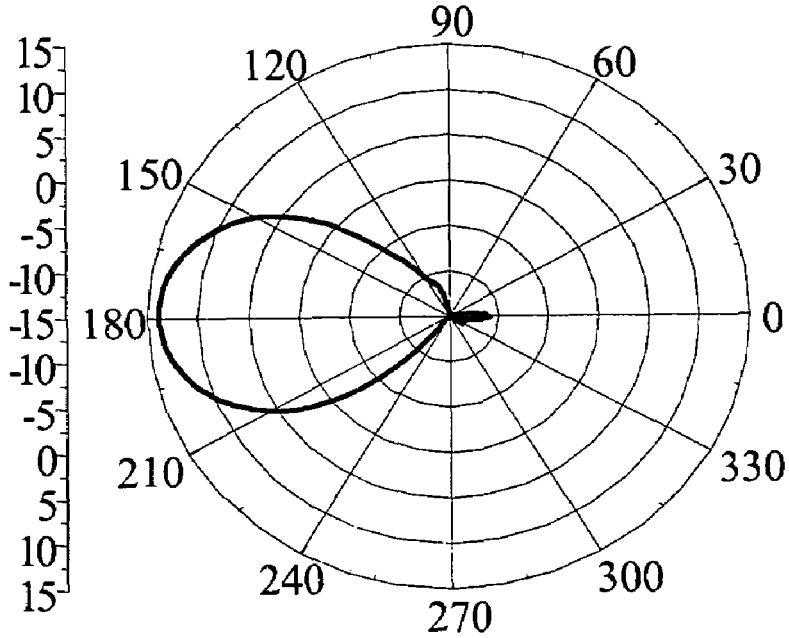
Figure 4C:
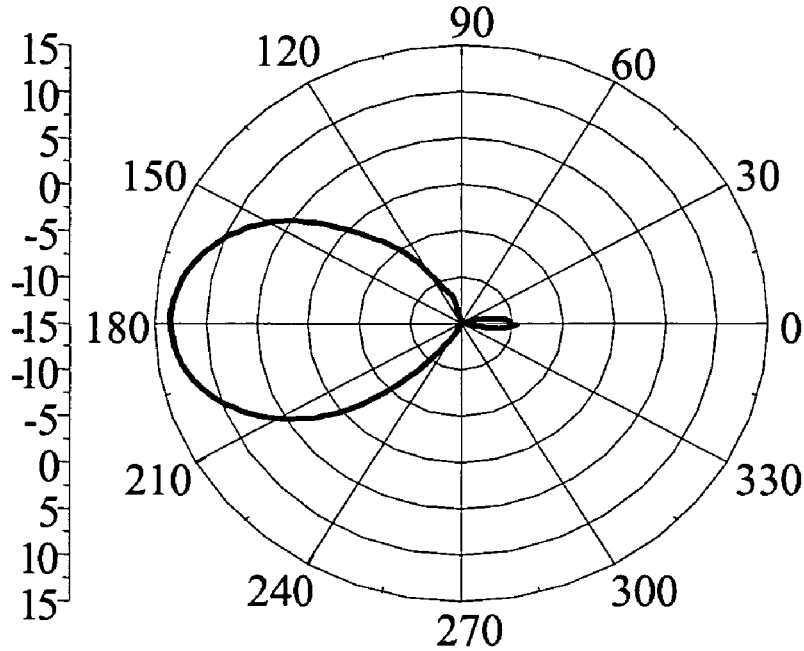
Figure 4D:
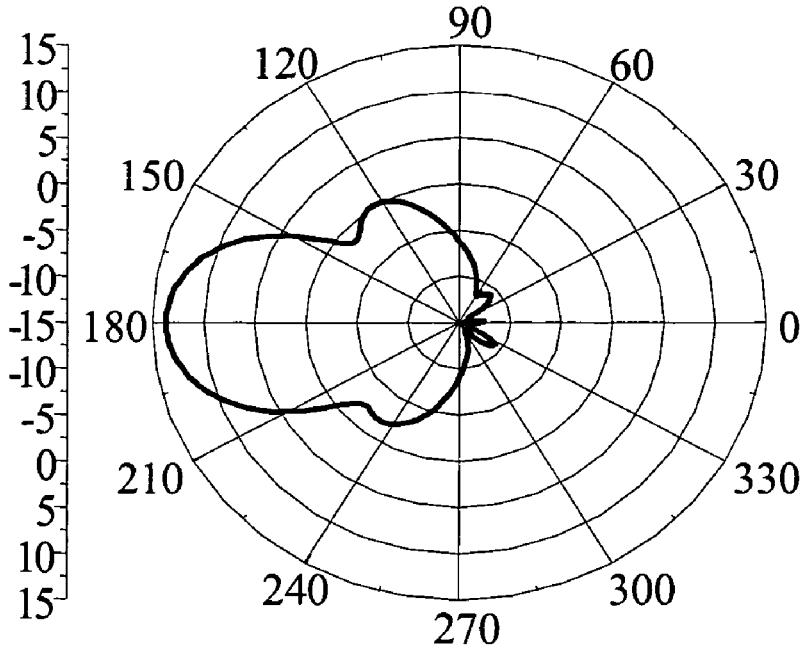
FIGS. 4D through 4F are charts showing the H-polarization radiation pattern of the first band according to the invention.
Figure 4E:
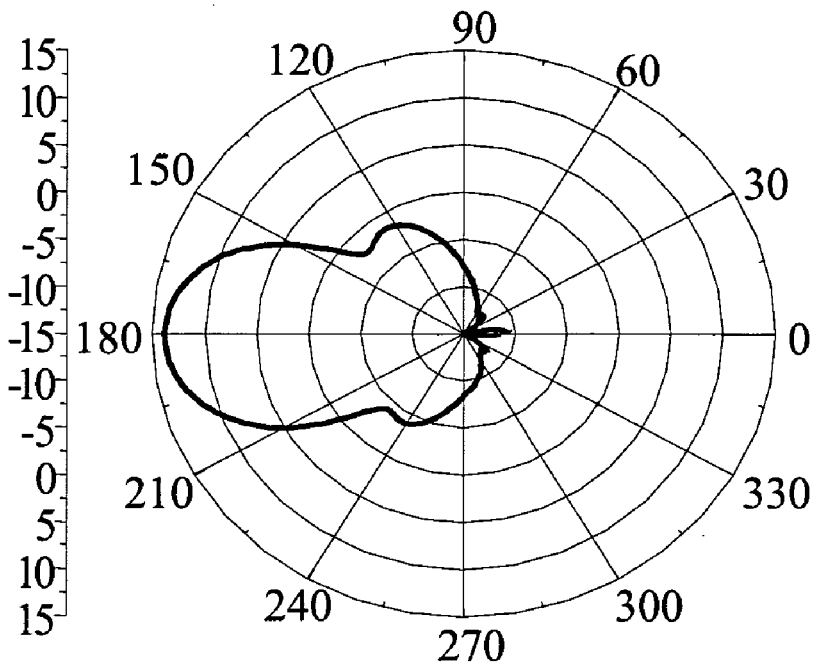
Figure 4F:
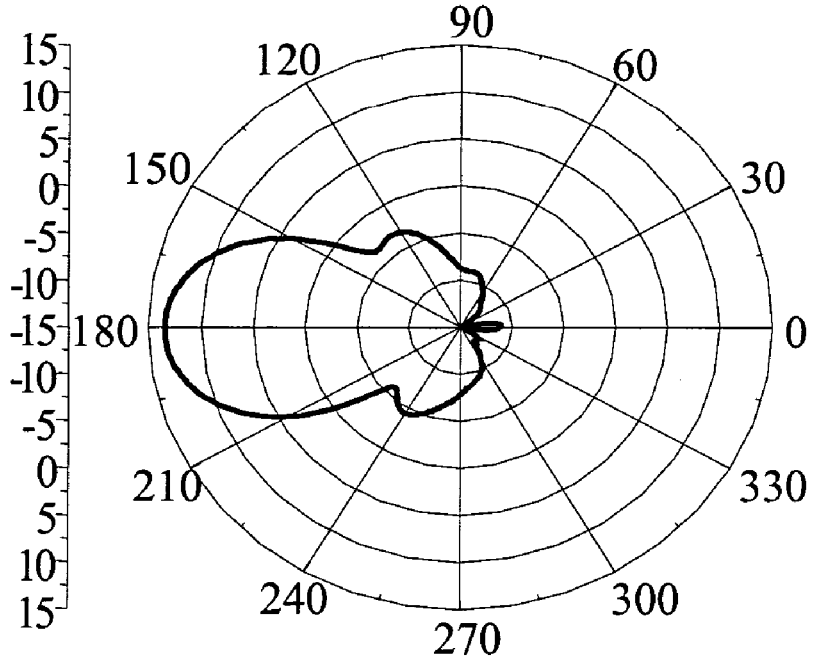
Figure 5A:
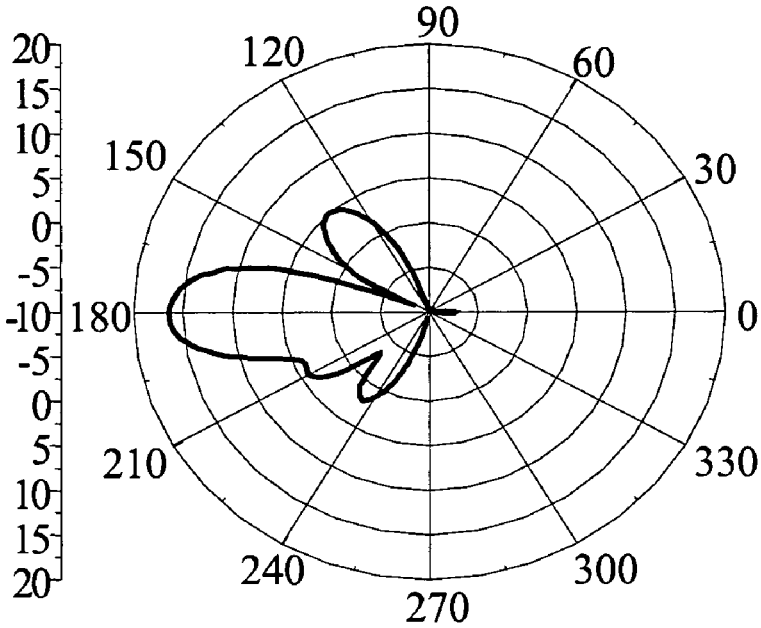
FIGS. 5A through 5D are charts showing the V-polarization radiation pattern of a second band according to the invention.
Figure 5B:
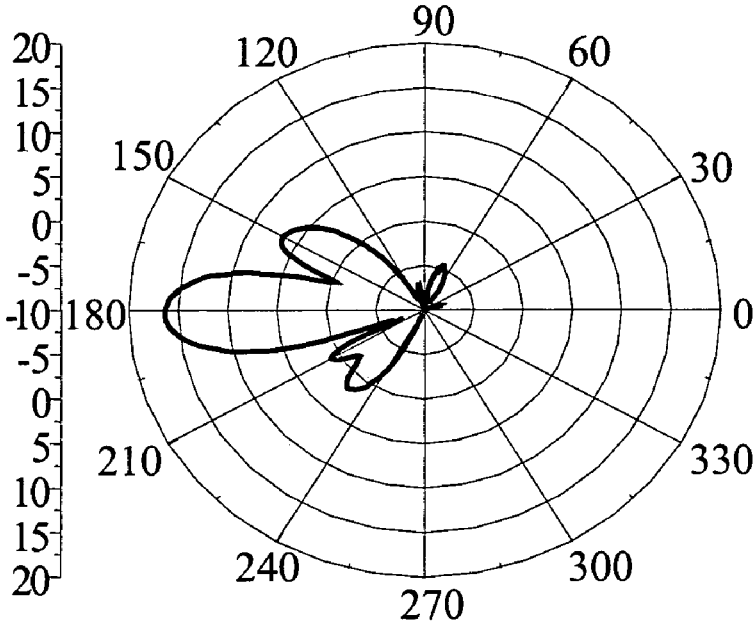
Figure 5C:
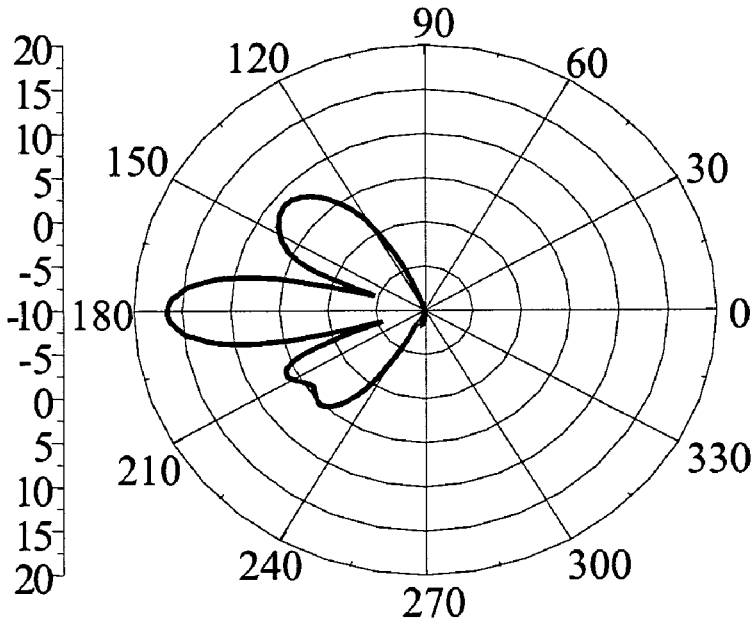
Figure 5D:
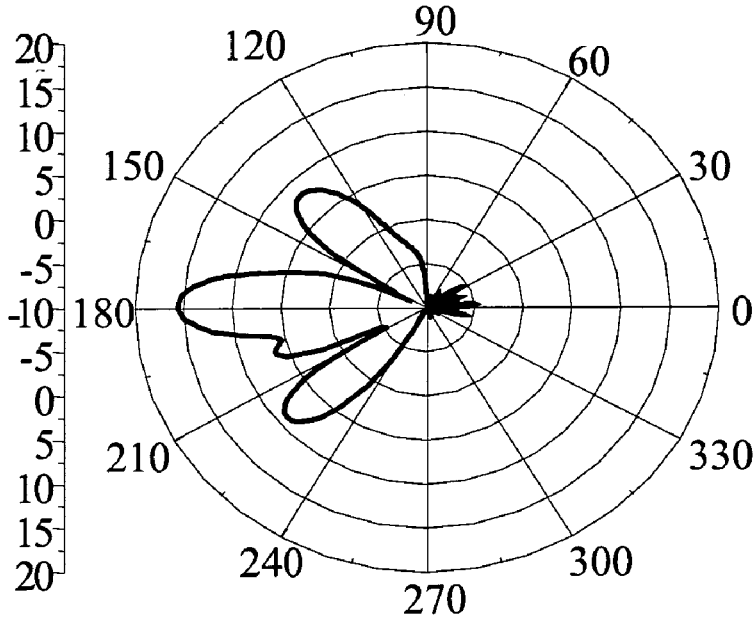
Figure 5E:
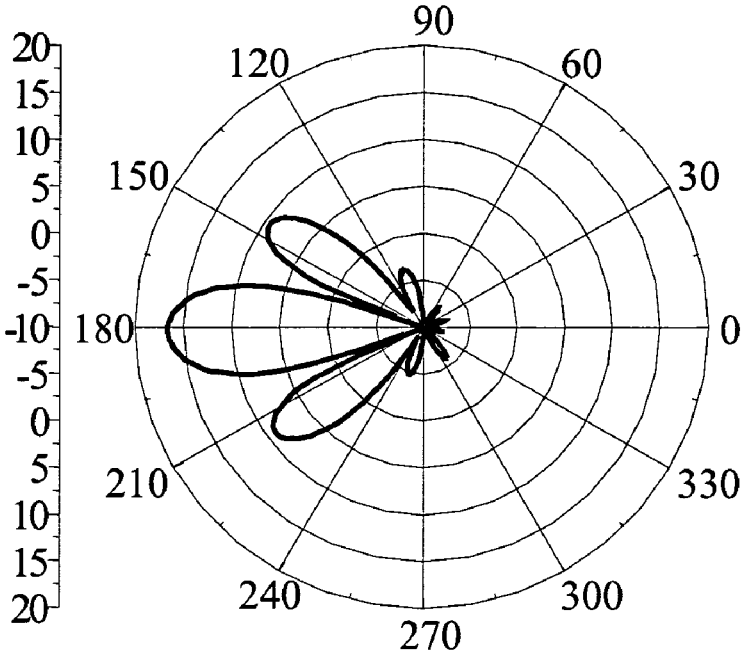
FIGS. 5E through 5H are charts showing the H-polarization radiation pattern of the second band according to the invention.
Figure 5F:
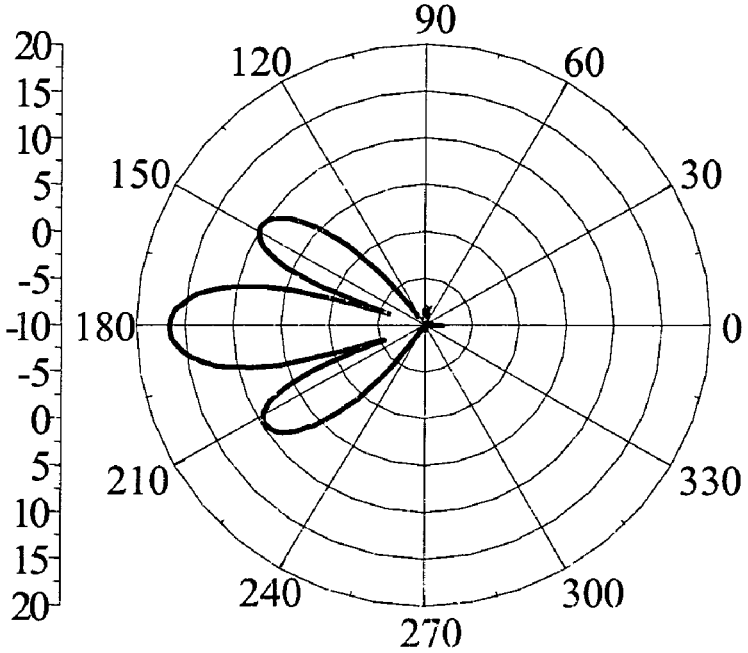
Figure 5G:
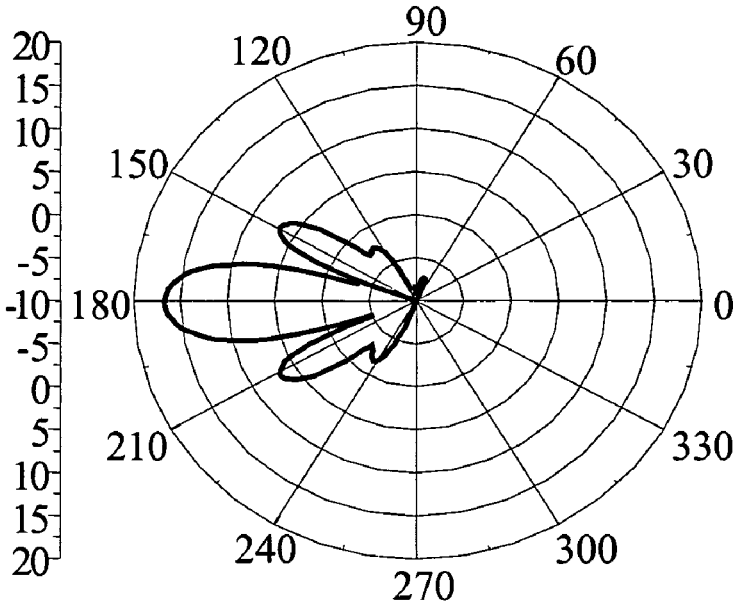
Figure 5H:
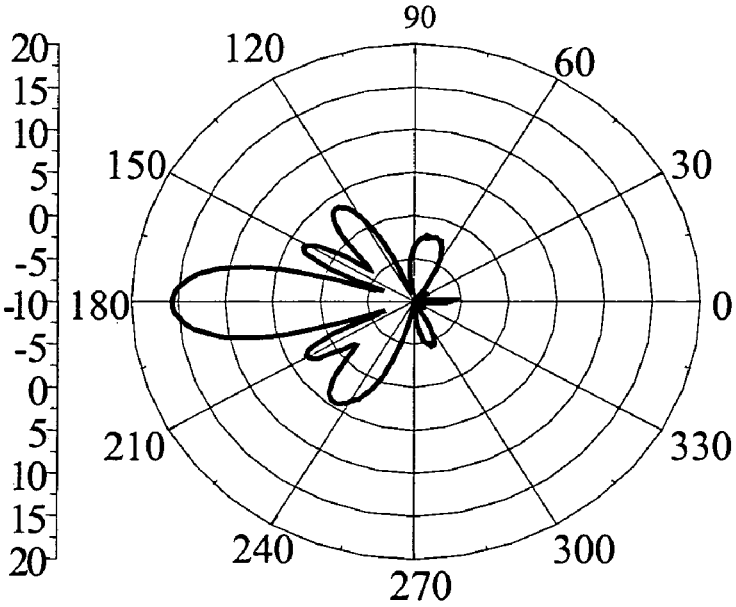

Practical tests of the embodiments of the invention have been conducted based on first band frequencies of 2.4 GHz, 2.45 GHz and 2.5 GHz, and second band frequencies of 4.9 GHz, 5.25 GHz, 5.6 GHz and 5.875 GHz. Refer to FIGS. 4A through 4C for the V-polarization radiation pattern of the first band, FIGS. 4D through 4F for the H-polarization radiation pattern of the first band, FIGS. 5A through 5D for the V-polarization radiation pattern of the second band, and FIGS. 5E through 5H for the H-polarization radiation pattern of the second band.

By means of the bi-frequency symmetrical patch antenna previously discussed, through symmetrical arrangement of the radiation units and power distribution units, the bandwidth of the bi-frequency antenna can be increased, and the feed-in power can be evenly distributed to each bi-frequency symmetrical radiation unit. By arranging the bi-frequency symmetrical radiation units in an array fashion, the directionality of the bi-frequency antenna is enhanced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A bi-frequency symmetrical patch antenna, comprising:

two bi-frequency symmetrical radiation units each having a first band radiation section and two second band radiation sections to radiate a feed-in signal of the bi-frequency symmetrical patch antenna; and a power distribution unit to evenly distribute a feed-in power corresponding to the feed-in signal to each of the bi-frequency symmetrical radiation units, wherein the two second band radiation sections are connected to the power distribution unit therough a second micro strip and a third micro strip.

2. The bi-frequency symmetrical patch antenna of claim 1, wherein the first band radiation section has a length greater than that of the second band radiation sections.

3. The bi-frequency symmetrical patch antenna of claim 1, wherein the power distribution unit is substantially formed in T-shape.

4. The bi-frequency symmetrical patch antenna of claim 1, wherein the first band radiation section is connected to the power distribution unit through a first micro strip.

5. The bi-frequency symmetrical patch antenna of claim 4, wherein the first band radiation section is located on a distal end of the first micro strip and connected to the distal end of the first micro strip.

6. The bi-frequency symmetrical patch antenna of claim 1, wherein the second band radiation section is located on a distal end of the second micro strip and connected to the distal end of the second micro strip.

7. The bi-frequency symmetrical patch antenna of claim 6, wherein the second micro strip is formed in a zigzag path and substantially in U-shape.

8. The bi-frequency symmetrical patch antenna of claim 1, wherein the second band radiation section is located on a distal end of the third micro strip and connected to the distal end of the third micro strip.

9. The bi-frequency symmetrical patch antenna of claim 8, wherein the third micro strip is formed in a zigzag path and substantially in U-shape.

10. An array type bi-frequency symmetrical patch antenna, comprising:

at least one bi-frequency symmetrical radiation unit each having a first band radiation section and two second band radiation sections to radiate a feed-in signal of the array type bi-frequency symmetrical patch antenna; and at least one power distribution unit to evenly distribute a feed-in power corresponding to the feed-in signal to each bi-frequency symmetrical radiation unit, the power distribution unit having two side arms connecting respectively to a distal end of a next power distribution unit, the next power distribution unit having another two side arms connecting respectively to each bi-frequency symmetrical radiation unit.

11. The array type bi-frequency symmetrical patch antenna of claim 10, wherein the first band radiation section has a length greater than that of the second band radiation sections.

12. The array type bi-frequency symmetrical patch antenna of claim 10, wherein the power distribution unit is substantially formed in T-shape.

13. The array type bi-frequency symmetrical patch antenna of claim 10, wherein the first band radiation section is connected to the power distribution unit through a first micro strip.

14. The array type bi-frequency symmetrical patch antenna of claim 13, wherein the first band radiation section is located on a distal end of the first micro strip and connected to the distal end of the first micro strip.

15. The array type bi-frequency symmetrical patch antenna of claim 10, wherein the two second band radiation sections are connected to the power distribution unit through a second micro strip and a third micro strip.

16. The array type bi-frequency symmetrical patch antenna of claim 15, wherein the second band radiation section is located on a distal end of the second micro strip and connected to the distal end of the second micro strip.

17. The array type bi-frequency symmetrical patch antenna of claim 16, wherein the second micro strip is formed in a zigzag path and substantially in U-shape.

18. The array type bi-frequency symmetrical patch antenna of claim 15, wherein the second band radiation section is located on a distal end of the third micro strip and connected to the distal end of the third micro strip.

19. The array type bi-frequency symmetrical patch antenna of claim 18, wherein the third micro strip is formed in a zigzag path and substantially in U-shape.

20. A bi-frequency symmetrical patch antenna, comprisng:

two bi-frequency symmetrical radiation units each having a first band radiation section and two second band radiation sections to radiate a feed-in signal of the bi-frequency symmetrical patch antenna; and a power distribution unit to evenly distribute a feed-in power corresponding to the feed-in signal to each of the bi-frequency symmetrical radiation units, wherein the power distribution unit is substantially formed in T-shape.

* * * * *